US008079799B2

(12) United States Patent
Rathbun et al.

(10) Patent No.: US 8,079,799 B2
(45) Date of Patent: Dec. 20, 2011

(54) APPARATUS AND METHOD FOR LIFTING CONTAINERS

(75) Inventors: Lee F. Rathbun, Babson Park, FL (US); David H. Osburn, Frostproof, FL (US)

(73) Assignee: Petersen Industries, Inc, Lake Wales, FL (US)

( * ) Notice: Subject to any disclaimer, the term of this patent is extended or adjusted under 35 U.S.C. 154(b) by 429 days.

(21) Appl. No.: 11/801,297

(22) Filed: May 9, 2007

(65) Prior Publication Data

US 2008/0279666 A1 Nov. 13, 2008

(51) Int. Cl.
*B66C 1/66* (2006.01)

(52) U.S. Cl. ..... 414/626; 294/81.56; 294/81.61; 414/486; 414/555; 414/732; 414/736; 414/739

(58) Field of Classification Search ..... 414/486, 414/555, 626, 732, 736, 739; 294/67.31, 294/81.51, 81.56, 81.61
See application file for complete search history.

(56) References Cited

U.S. PATENT DOCUMENTS

| | | | | |
|---|---|---|---|---|
| 3,044,819 | A * | 7/1962 | Pierre | 294/88 |
| 3,164,406 | A * | 1/1965 | Barry | 294/88 |
| 3,249,064 | A * | 5/1966 | Barry | 104/93 |
| 3,713,554 | A | 1/1973 | Thompson | 214/147 |
| 3,719,296 | A * | 3/1973 | Larson, Jr. | 414/422 |
| 3,796,332 | A * | 3/1974 | Kawamura | 414/733 |
| 3,899,205 | A * | 8/1975 | Lanigan et al. | 294/67.31 |
| 3,904,231 | A * | 9/1975 | Lyons | 294/81.56 |
| 4,012,069 | A | 3/1977 | Carson | 294/70 |
| 4,175,903 | A | 11/1979 | Carson | 414/408 |
| 4,260,323 | A * | 4/1981 | Muntjanoff | 414/731 |
| 4,552,501 | A | 11/1985 | Clark | 414/486 |
| 5,222,853 | A | 6/1993 | Carson | 414/408 |
| 6,220,811 | B1 | 4/2001 | Bernecker | 414/555 |
| 2007/0296229 | A1 * | 12/2007 | Chauvin et al. | 294/81.61 |

* cited by examiner

*Primary Examiner* — James Keenan
(74) *Attorney, Agent, or Firm* — Greer, Burns & Crain Ltd.

(57) ABSTRACT

A lifting apparatus is adapted for use in lifting a container having a pair of channels, each of the channels having a pair of open ends. The lifting apparatus includes an elongated support bar and a hook assembly mounted on each end of the support bar. Each of the hook assemblies includes a pair of hooks and a hydraulic cylinder and piston for rotating the hooks between open and closed positions. The container is lifted by lowering the support bar with the hooks in the open position until the hooks can be rotated into the open ends of the two channels. The hooks are then rotated to the closed position so that the hooks extend into the channels. The lifting apparatus is then raised to lift the container.

7 Claims, 5 Drawing Sheets

APPARATUS AND METHOD FOR LIFTING CONTAINERS

BACKGROUND

This invention relates to an apparatus and method for lifting containers, in particular, refuse containers which include a pair of side channels which provide fork pockets.

The refuse and solid waste collection industry in the United States generally uses four or five container sizes. The containers conventionally include a pair of parallel channels which provide fork pockets so that fill containers can be lifted by front loader collection trucks.

Empty containers are generally delivered to the waste collection site by a small truck which carries one container at a time and which may pull a trailer carrying more containers or by a flatbed truck which is equipped with a knuckleboom crane. The knuckleboom crane unloads the containers using slings or chains and occasionally requires a second man.

SUMMARY OF THE INVENTION

The invention provides a lifting apparatus and method for loading and unloading containers, particularly refuse containers, in a faster, safer, and more economical manner.

The apparatus includes a pair of hook assemblies, and each hook assembly includes a pair of pivoting hooks which are adapted to pivot into the fork pockets on one side of the container. The lifting apparatus is advantageously connected to a hydraulically operated boom or crane. When both pockets are engaged by a pair of hooks, the apparatus is raised to lift the container. The lifting apparatus can be mounted on a truck which has the capacity for carrying multiple containers, so that a single person can deliver multiple containers in one trip.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
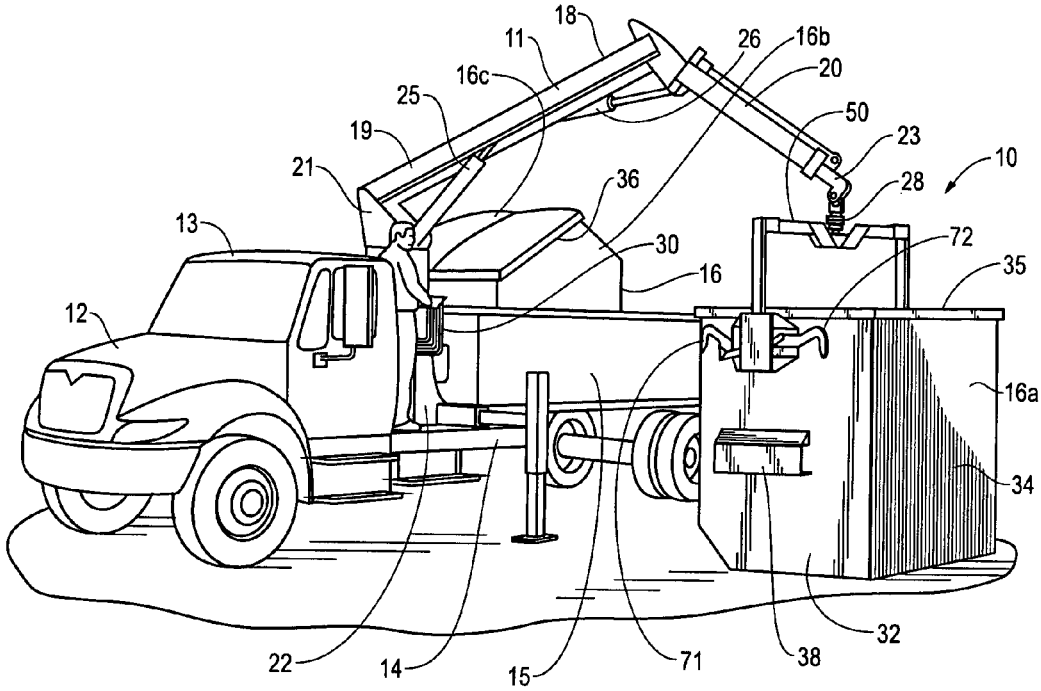
FIG. 1 is a perspective view of a truck with a hydraulic boom which is equipped with a lifting apparatus in accordance with the invention.

Referring to FIG. 1, the inventive lifting apparatus 10 is mounted on the end of a hydraulically operated loading apparatus 11 which is mounted on a vehicle 12. The vehicle 12 includes a truck cab 13, a chassis 14, and a truck body 15 which is adapted to hold a plurality of refuse containers 16. The particular truck body 15 which is illustrated is sized to hold three 8 cubic yard containers 16.

The loading apparatus 11 is advantageously of the type which is described in U.S. Pat. No. 4,012,069 and U.S. patent application Ser. No. 11/301,778, filed Dec. 13, 2005, which are incorporated herein by reference. The loading apparatus includes a two-part main boom 18 which includes a main boom arm 19 and tip boom arm 20. The main boom is mounted on a rotating head 21 which is rotatably supported by pedestal 22 which is mounted on the vehicle body. The tip boom arm 20 is pivotally connected to the main boom arm 19. A tip extension boom 23 is telescopingly received within the tip boom 20.

The main boom arm 19 and tip boom arm 20 are raised and lowered by hydraulic cylinders 25 and 26. The tip extension boom is extended and retracted by a hydraulic cylinder within the tip boom 20. The lifting apparatus 10 is pivotally and rotatably connected to the tip boom extension boom 23 by a conventional hydraulically operated rotary swivel 28.

The loading apparatus 11 and lifting apparatus 10 may be operated by lever arms or handles 30 on the vehicle 12. As described in U.S. Ser. No. 11/301,778, the lever arms operate a plurality of conventional hydraulic actuators which are connected to the hydraulically operated components of the loading apparatus and the lifting apparatus by hydraulic hoses. Alternatively, as described in Ser. No. 11/301,778, the hydraulic actuators can be operated by joysticks. One of the hydraulic actuators slews or rotates the main boom. Other actuators raise and lower the main boom and the tip boom. Another actuator extends and retracts the tip extension boom. Another actuator rotates the rotary swivel 28.

The refuse container 16 includes a pair of generally parallel vertical side walls 32, a front wall 33 (FIG. 3), and a back wall 34. The container 16*a* which is on the ground in FIG. 1 has a horizontal top opening 35. The containers 16*b* and 16*c* which are on the trailer body 15 include inclined hinged covers 36.

Figure 2:
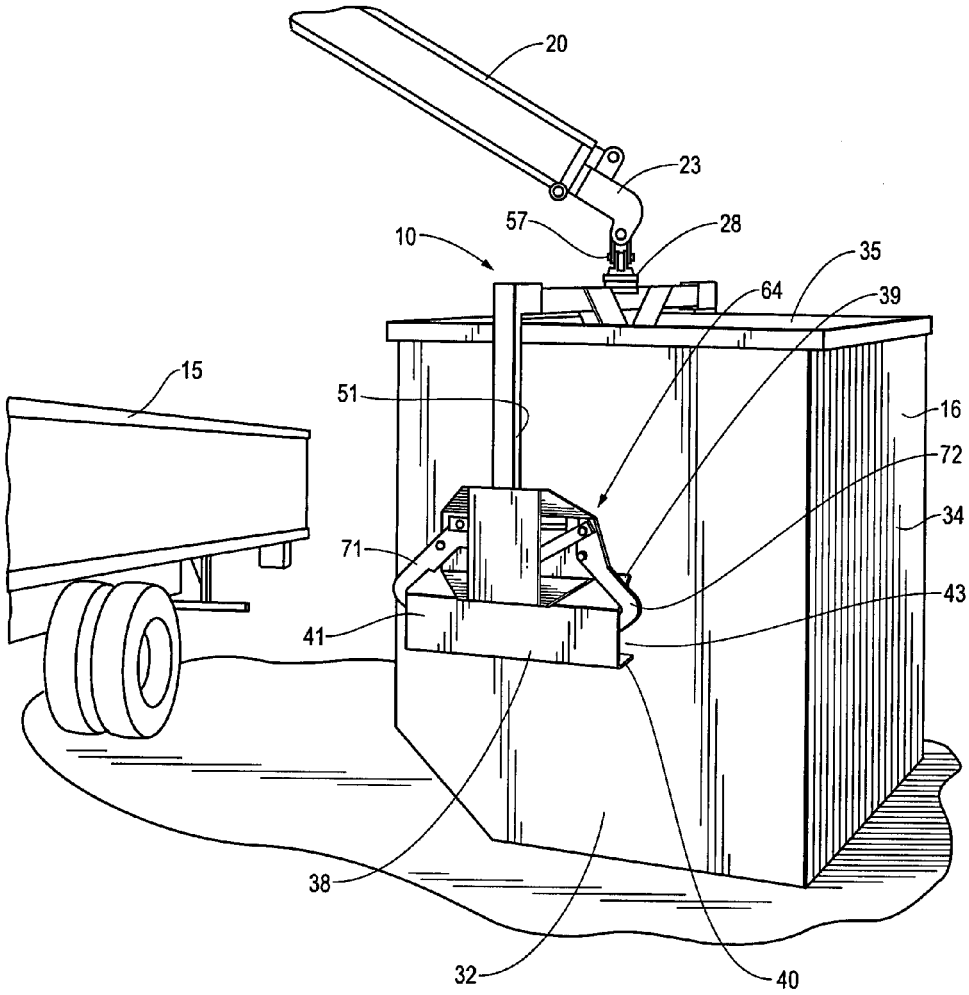
FIG. 2 is a fragmentary perspective view showing the lifting apparatus engaging one of the fork pockets of a refuse container.
Figure 3:
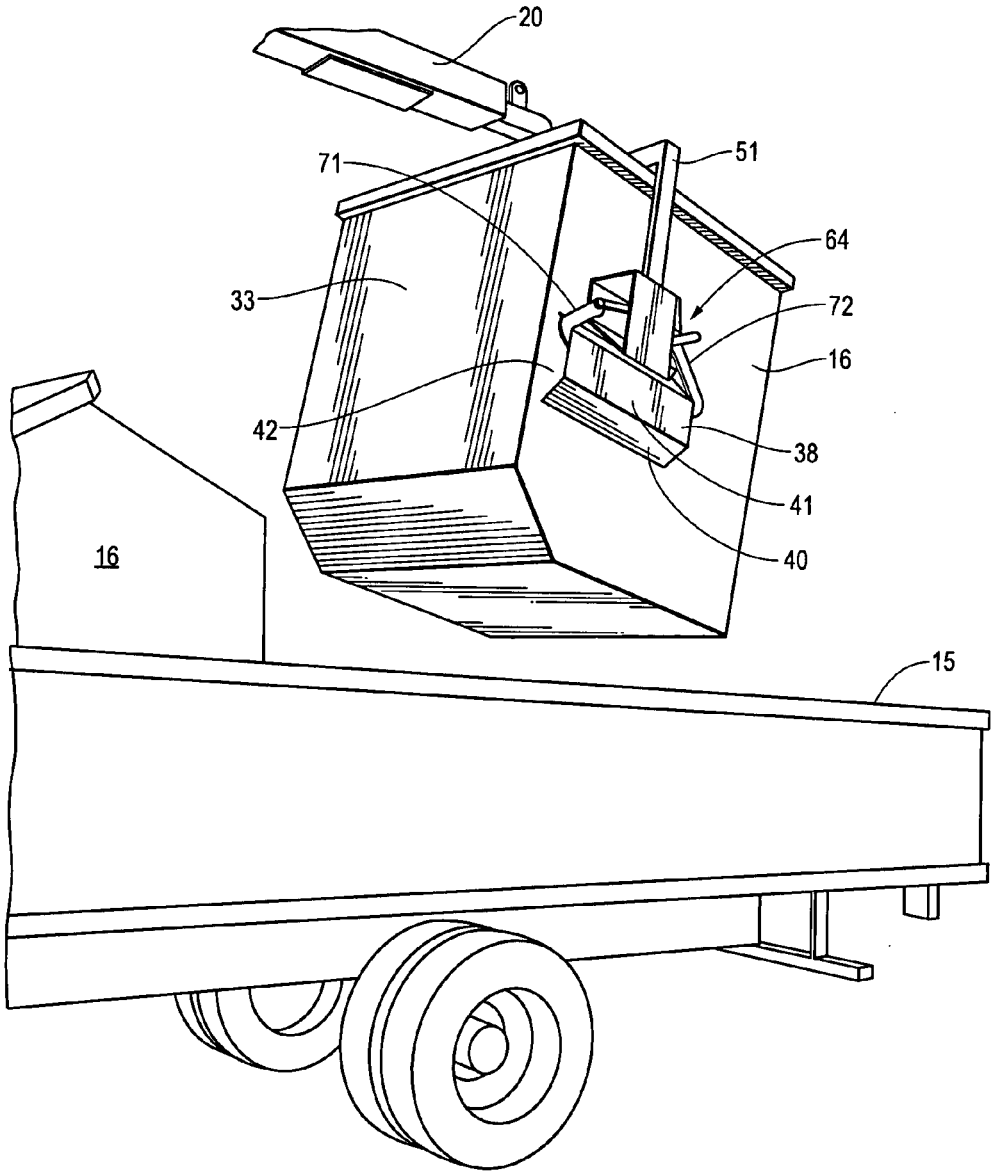
FIG. 3 is a fragmentary perspective view showing the lifting apparatus lifting a refuse container into the truck.

Each of the containers includes a pair of generally parallel, generally horizontally extending channels 38 which are mounted on the two side walls of the container. Each of the channels includes top and bottom walls 39 and 40 and an outer wall 41 which provide open front and back ends 42 and 43 (FIGS. 1-3). The top and bottom walls of the channels are welded or otherwise secured to the side walls of the container.

The containers 16 with the channels 38 are conventional and are commonly used in the solid waste collection industry. The two open-ended channels provide generally parallel fork pockets on the sides of the container which enable the full container to be lifted by conventional front loader collection trucks.

Figure 4:
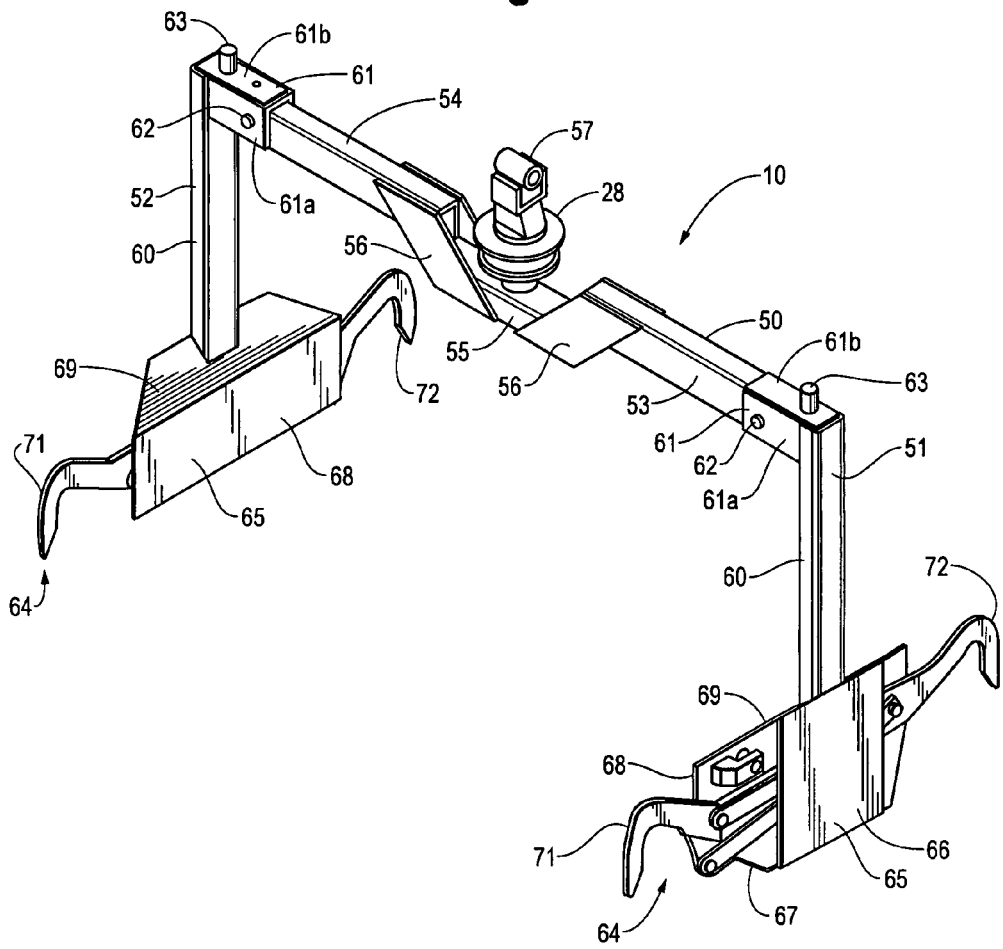
FIG. 4 is a perspective view of the lifting apparatus.

Referring to FIG. 4, the lifting apparatus 10 includes an elongated horizontal support bar 50 and a pair of vertical side bars or arms 51 and 52. The particular horizontal support bar illustrated includes a pair of tubular end bars 53 and 54 which are connected to an intermediate tubular bar 55 by gusset plates 56. The rotary swivel 28 is mounted on the intermediate bar, and a universal joint 57 is mounted on the rotary swivel for connecting the lifting apparatus 10 to the boom apparatus 11. The rotary swivel is connected to a hydraulic actuator on the vehicle by a hydraulic hose (not shown).

Each of the vertical side bars 51 and 52 includes a tubular vertical bar 60 and a short horizontal channel 61 which slides over the end of one of the end bars 53 and 54. Each channel 61 is formed by a pair of vertical side plates 61*a* and a horizontal top plate 61*b* which are welded together. Each vertical arm 51 and 52 is pivotally connected to the end bar 53 or 54 by a bolt 62 which extends through the vertical plates 61*a* and transversely through the end bar. A bolt 63 is threaded through each of the top plates 61*b* and engages the top of the end bar 53 or 54 for adjusting the hanging angle of the vertical arms 51 and 52 relative to the end bars 53 and 54.

When a bolt 63 is screwed downwardly, the associated vertical arm 51 or 52 will pivot outwardly or away from the other vertical arm about the horizontal pivot provided by the bolt 62. When a bolt is unscrewed, the associated vertical arm will pivot inwardly or toward the other vertical arm.

A hook assembly 64 is attached to the lower end of each of the vertical side bars 51 and 52. Each of the hook assemblies includes a generally channel-shaped housing or frame 65 which is formed by a vertical outside plate 66 which is welded or otherwise attached to the side bar 51 or 52, an inclined bottom plate 67, a vertical inside plate 68, and an inclined top plate 69. An opening in the top plate 69 accommodates the side bar 51 or 52.

Figure 6:
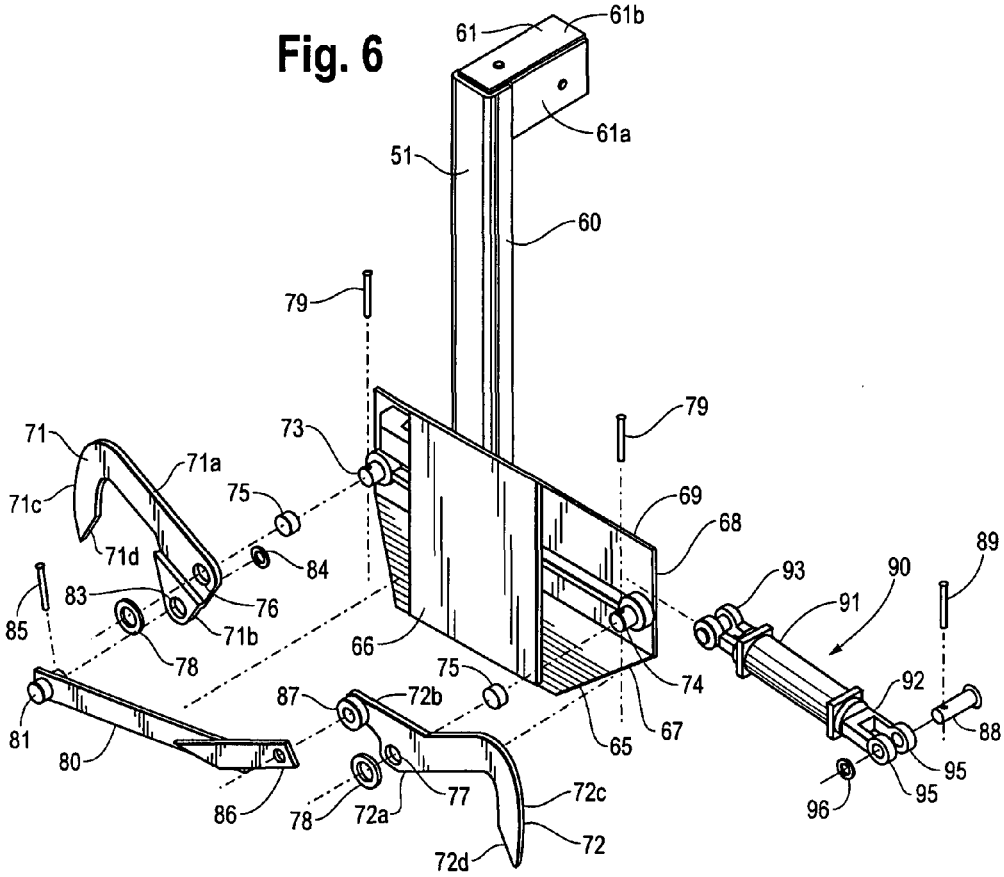
FIG. 6 is an exploded view of one end of the lifting apparatus.

Front and back hooks 71 and 72 are pivotally mounted on the inside plate 68. Referring to FIG. 6, the front hook includes a mounting portion 71*a*, a crank arm portion 71*b*, and a hooked end portion 71*c* which extends generally perpendicularly to the mounting portion. The hooked end portion includes a straight container-engaging edge 71*d*. The back hook 72 includes a mounting portion 72*a*, a crank arm portion 72*b*, and a hooked end portion 72*c* which extends generally perpendicularly to the mounting portion 72*b*. The end portion includes a straight container-engaging edge 72*d*.

Pivot pins 73 and 74 are mounted on the inside plate 68. A bronze bushing 75 is mounted on each pivot pin. The hooks 71 and 72 are provided with pivot pin openings 76 and 77, respectively, for the pivot pins and bushings. Each hook is retained on the pivot pin by a washer bushing 78 and a cotter pin 79 which is inserted into an opening in the pivot pin.

The crank arms 71*b* and 72*b* of the front and back hooks 71 and 72 are connected by a link 80. A pivot pin 81 is mounted on the front end of the link, extends through an opening 83 in the crank arm 71*b* of the front hook 71, and is secured by a washer 84 and cotter pin 85. An opening 86 is provided in the back end of the link 80, and a bushing 87 is attached to the crank arm 72*b* of the hook 72. The link 80 is pivotally connected to the crank arm 72*b* of the hook 72 and the bushing 87 by a pivot pin 88 (FIGS. 5 and 6) and a cotter pin 89.

A double-acting hydraulic cylinder and piston assembly 90 includes a cylinder 91 and a piston 92. The cylinder includes a mounting bushing 93 which is pivotally mounted on a pivot pin 94 (FIG. 5) on the inside plate 68. The piston 92 includes a clevis 95 which is pivotally connected to the crank arm 72*b* by the same pivot pin 88 which connects the link 80 to the crank arm. A washer 96 is mounted on the pin between the clevis 95 and the crank arm 72*b*.

Figure 5:
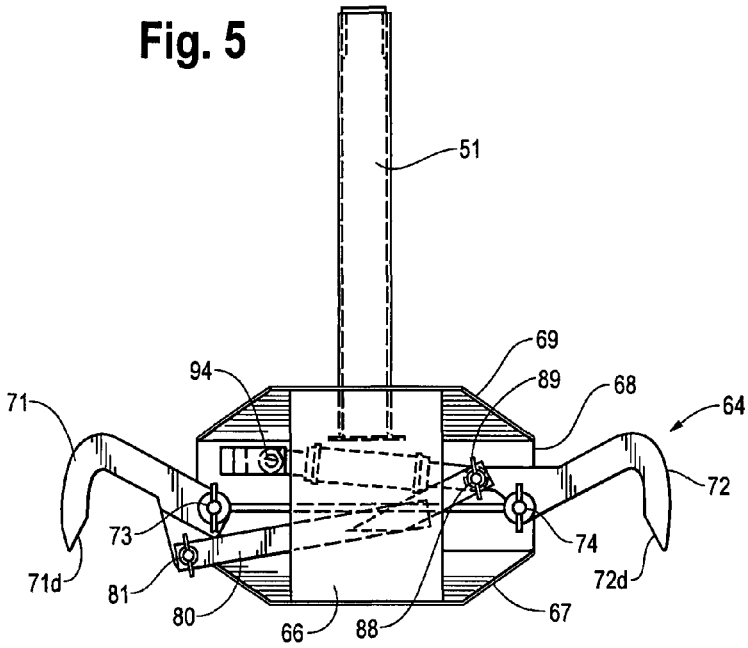
FIG. 5 is a side view of the lifting apparatus.

The hydraulic cylinders 90 of the two hook assemblies 64 are connected to a hydraulic actuator on the vehicle by a hydraulic hose (not shown). When the pistons 91 are retracted, the crank arm 72*b* of each back hook 72 is rotated counterclockwise as illustrated in FIG. 5 so that the hooked end 72*c* extends generally downwardly. At the same time, the link 80 rotates the crank arm 71*b* of the front hook 71 clockwise so that the hooked end 71*c* also extends generally downwardly. When the piston 91 is extended, the hooks rotate in the opposite direction.

Each of the hooks 71 and 72 of each of the hook assemblies rotates or pivots about an axis which extends generally parallel to the support bar 50 so that each pair of hooks rotates in a plane which extends generally perpendicularly to the support bar and generally parallel to the side wall 32 of the container.

FIG. 1 illustrates the lifting apparatus in the process of engaging a container which is to be lifted into the truck body 15. The main boom arm 18 and tip boom arm 20 are hydraulically operated to lower the lifting apparatus over the container. The rotary swivel 28 is hydraulically operated to position the support bar 50 so that it extends perpendicularly to the side walls of the container. The booms lower the lifting apparatus so that the hooks 71 and 72 straddle the channels 38 on each side of the container. The hydraulic cylinders 90 of the hook assemblies are actuated to retract the pistons 91 so that the hooks are maintained in an open position in which the ends of the hooks are spaced farther apart than the open ends of the channels 38.

The lifting apparatus is lowered until the hooks are in position so that they can be rotated to a closed position in which the hooks can extend into the open ends of the channels 38 as illustrated in FIG. 2. The channels 61 and bolts 62 allow the vertical arms 51 and 52 to be pivoted slightly inwardly or outwardly to allow for variances in container width. The hooks are rotated by extending the pistons 91. When the hooks extend into the channels 38, the container-engaging edges 71*d* and 72*d* will engage the top walls 39 of the channels when the lifting apparatus is raised.

When the hooks are positioned in the fork pockets of the channels, the booms are operated to lift the container 16 and rotate it over the truck body 15 as illustrated in FIG. 3. The booms are then operated to lower the container into the truck body. The hydraulic cylinders 90 are then operated to open the hooks 71 and 72 so that the lifting apparatus 10 can be raised above the container.

Containers are unloaded from the truck body 15 by following the reverse procedure.

The lifting apparatus 10 is particularly suitable for lifting empty refuse containers. However, the lifting apparatus could also be used to lift full containers.

While in the foregoing specification a detailed description of a specific embodiment of the invention was set forth, it will be understood that many of the details herein given may be varied considerably by those skilled in the art without departing from the spirit and scope of the invention.

We claim:

1. A lifting apparatus comprising:

a) an elongated generally horizontal support bar having first and second ends, wherein a first axis is defined along a direction generally parallel to a length of said support bar;

b) first and second arms pivotally connected to the support bar, each of the first and second arms having first and second ends, wherein the first end of the first arm is pivotally connected to the first end of the support bar and is substantially pivotable only in a direction toward or away from the second arm about a horizontal second axis that is perpendicular to the first axis generally parallel to the support bar, wherein the first end of the second arm is pivotally connected to the second end of the support bar and is substantially pivotable only in a direction toward or away from the first arm about a horizontal third axis that is perpendicular to the first axis;

c) a hook assembly mounted on the second end of each of the first and second arms, each hook assembly comprising:

i) a frame;

ii) first and second hooks pivotally mounted on the frame, each of the hooks being pivotable only in a plane generally parallel to the second and third axes; and iii) a single cylinder and piston assembly for pivoting the hooks, said cylinder and piston assembly being connected to the first hook, and a link directly connecting the first and second hooks whereby pivoting movement of the first hook pivots the second hook; and wherein pivoting of the first and second arms about the second and third axes moves the entire hook assemblies toward or away from each other.

2. The apparatus of claim 1 including a rotary swivel attached to the support bar whereby the support bar and the hook assemblies can be rotated together as a unit.

3. The apparatus of claim 1 wherein each of the first and second arms includes a generally vertical arm which is connected to one of the hook assemblies and a generally horizontal member which is connected to the first and second ends of the support bar, respectively.

4. The apparatus of claim 3 in which each of said horizontal members is pivotally connected to the first and second ends of the support bar, respectively.

5. In combination with a container having a pair of spaced-apart parallel channels, each of the channels having a pair of open ends, a lifting apparatus comprising:

a) an elongated generally horizontal support bar having first and second ends, wherein a first axis is defined along a direction generally parallel to a length of said support bar;

b) first and second arms pivotally connected to the support bar, each of the first and second arms having first and second ends, wherein the first end of the first arm is pivotally connected to the first end of the support bar and is substantially pivotable only in a direction toward or away from the second arm about a horizontal second axis that is perpendicular to the first axis generally parallel to the support bar, wherein the first end of the second arm is pivotally connected to the second end of the support bar and is substantially pivotable only in a direction toward or away from the first arm about a horizontal third axis that is perpendicular to the first axis;

c) a hook assembly mounted on the second end of each of the first and second arms of the support bar, each hook assembly comprising:

i) a frame;

ii) first and second hooks pivotally mounted on the frame, each of the hooks having an engaging end for engaging one of the channels and being pivotable only in a plane generally parallel to the second and third axes; and iii) a single cylinder and piston assembly for pivoting the hooks, said cylinder and piston assembly being connected to the first hook, and a link directly connecting the first and second hooks whereby pivoting movement of the first hook pivots the second hook; and wherein pivoting of the first and second arms about the second and third axes moves the entire hook assemblies toward or away from each other.

6. The apparatus of claim 5 including a rotary swivel attached to the support bar whereby the support bar and the hook assemblies can be rotated together as a unit.

7. A lifting apparatus comprising:

an elongated generally horizontal support bar having first and second ends, wherein a first axis is defined along a direction generally parallel to a length of said support bar;

first and second arms pivotally connected to the first and second ends of the support bar, respectively, each of the first and second arms having first and second ends;

a hook assembly mounted on the second end of each of the first and second arms, each hook assembly comprising a frame, first and second hooks pivotally mounted on the frame, and a cylinder and piston assembly for pivoting the hooks;

wherein the frame of each hook assembly is connected to the second end of one of said first and second arms, wherein the first and second arms can only be pivoted in a direction toward or away from each other about respective horizontal axes that are perpendicular to said first axis, wherein pivoting of the first and second arms moves the entire hook assemblies toward or away from each other;

wherein when the first and second arms are positioned such that the first and second arms extend generally perpendicularly from the support arm each of the hooks are pivotable only in a plane generally perpendicular to the first axis.

* * * * *

UNITED STATES PATENT AND TRADEMARK OFFICE

CERTIFICATE OF CORRECTION

PATENT NO. : 8,079,799 B2
APPLICATION NO. : 11/801297
DATED : December 20, 2011
INVENTOR(S) : Lee F. Rathbun et al.

It is certified that error appears in the above-identified patent and that said Letters Patent is hereby corrected as shown below:

In the Specification:

Col. 1, line 12 Please delete "fill" and insert --full-- therefor.

Signed and Sealed this
Thirty-first Day of July, 2012

David J. Kappos

David J. Kappos
*Director of the United States Patent and Trademark Office*